US006894584B2

(12) United States Patent
Yi

(10) Patent No.: US 6,894,584 B2
(45) Date of Patent: May 17, 2005

(54) THIN FILM RESONATORS

(75) Inventor: Huai Ren Yi, Schaumburg, IL (US)

(73) Assignee: Isco International, Inc., Mount Prospect, IL (US)

( * ) Notice: Subject to any disclaimer, the term of this patent is extended or adjusted under 35 U.S.C. 154(b) by 194 days.

(21) Appl. No.: 10/217,273

(22) Filed: Aug. 12, 2002

(65) Prior Publication Data

US 2004/0027211 A1 Feb. 12, 2004

(51) Int. Cl.[7] ..... H01P 7/00; H01B 12/02
(52) U.S. Cl. ..... 333/99 S; 505/210
(58) Field of Search ..... 333/99 S, 202, 333/222, 185, 219, 99, 1, 206, 187, 204, 207, 231, 224, 225; 324/248, 318, 316; 505/210, 430, 470, 451, 452

(56) References Cited

U.S. PATENT DOCUMENTS

| | | | | |
|---|---|---|---|---|
| 2,752,494 A | 6/1956 | Finke et al. | ..... | 331/101 |
| 3,246,266 A | 4/1966 | Racy | ..... | 333/231 |
| 3,760,482 A | 9/1973 | Kawamura | ..... | 29/896.22 |

(Continued)

FOREIGN PATENT DOCUMENTS

| | | |
|---|---|---|
| DE | 2123823 | 11/1971 |
| EP | 0 082 767 | 6/1983 |
| WO | WO88/08622 | 11/1988 |

OTHER PUBLICATIONS

Alford et al., Surface Resistance of Bulk and Thick Film $YBa_2CU_3O_x$, IEEE Transactions on Magnetics, vol. 27, No. 2, pp. 1510–1518, Mar. 1991.

Anatol I. Zverev, Handbook of Filter Synthesis, (Wiley, New York, 1967).

Dick et al., "The Superconducting Split Ring Resonator as an Accelerating Structure," Nuclear Instruments and Methods 138:203–207 (1976).

J.R. Delayen, G.J. Dick and J.E. Mercereau, "Test of A $\beta \simeq 0.1$ Superconducting Split Ring Resonator," IEEE, 17(1), Jan. 1981.

J.S. Hong, M.J. Lancaster, D. Jsdamzik, and R.B. Greed, "On the Development of Superconducting Microstrip Filters for Mobile Communications Applications," IEEE trans. Microwave Theory Tech., vol. 47, No. 9, pp. 1656–1663, 1999.

Kurt F. Raihn, Robby Alvarez, Jim Costa, Greg L. Hey–Shipton, "Highly Selective HTS Band Pass Filter with Multiple Resonator Cross–Coupling," IEEE Superconductor Technologies Inc., Santa Barbara, CA 93111–2310 USA, 2000.

Lancaster et al., "Superconducting Microwave Resonators," IEEE Proceedings–H, vol. 139, No. 2, pp. 149–156, Apr. 1992.

(Continued)

*Primary Examiner*—Patrick Wamsley
(74) *Attorney, Agent, or Firm*—Marshall, Gerstein & Borun LLP

(57) ABSTRACT

A thin film resonator which combines a microstrip resonator structure and a coplanar resonator structure to form an integrated resonator structure. The resonant frequency of this resonator structure is independent of the substrate thickness within a certain thickness range. This resonator structure also has a very economical size, as compared to other existing resonator designs. Different coupling configurations between the resonators are shown with the resulting coupling coefficients. Also a two-pole, four-pole and an eight-pole filter are designed using the thin film resonator and the insertion loss and return loss characteristics for various filters are shown.

17 Claims, 16 Drawing Sheets

U.S. PATENT DOCUMENTS

| | | | | | |
|---|---|---|---|---|---|
| 3,872,413 | A | | 3/1975 | Schneider | 333/224 |
| 4,207,548 | A | | 6/1980 | Graham et al. | 333/225 |
| 4,318,064 | A | | 3/1982 | Käch | 333/202 |
| 4,344,052 | A | | 8/1982 | Davidson | 333/222 |
| 4,431,977 | A | | 2/1984 | Sokola et al. | 333/206 |
| 4,441,088 | A | | 4/1984 | Anderson | 333/1 |
| 4,446,429 | A | | 5/1984 | Froncisz et al. | 324/316 |
| 4,463,328 | A | | 7/1984 | Doty | 333/222 |
| 4,504,788 | A | | 3/1985 | Froncisz et al. | 324/316 |
| 4,559,504 | A | | 12/1985 | Krec | 337/194 |
| 4,728,779 | A | | 3/1988 | Kotani et al. | 219/517 |
| 4,742,320 | A | | 5/1988 | Pfizenmaier et al. | 333/219 |
| 4,812,791 | A | | 3/1989 | Makimoto et al. | 333/219 |
| 4,841,249 | A | | 6/1989 | Duerr et al. | 324/318 |
| 4,879,533 | A | | 11/1989 | de Muro et al. | 333/206 |
| 4,918,050 | A | | 4/1990 | Dworsky | 505/210 |
| 4,996,188 | A | | 2/1991 | Kommrusch | 505/210 |
| 5,011,823 | A | | 4/1991 | Jin et al. | 505/452 |
| 5,051,704 | A | | 9/1991 | Chapman et al. | 330/52 |
| 5,055,808 | A | | 10/1991 | Walker et al. | 333/207 |
| 5,157,017 | A | | 10/1992 | Jin et al. | 505/451 |
| 5,172,085 | A | | 12/1992 | Glenat et al. | 333/222 |
| 5,179,074 | A | | 1/1993 | Fiedziuszko et al. | 505/430 |
| 5,210,511 | A | | 5/1993 | Izumi et al. | 333/222 |
| 5,272,132 | A | | 12/1993 | Gyorgy et al. | 505/210 |
| 5,304,968 | A | | 4/1994 | Ohtonen et al. | 333/222 |
| 5,324,713 | A | | 6/1994 | Shen | 505/210 |
| 5,340,797 | A | | 8/1994 | Hodge et al. | 505/470 |
| 5,409,889 | A | | 4/1995 | Das | 505/210 |
| 5,434,547 | A | | 7/1995 | Kaida et al. | 333/187 |
| 5,457,087 | A | | 10/1995 | Dorothy et al. | 505/210 |
| 5,585,331 | A | | 12/1996 | Mansour et al. | 505/210 |
| 5,594,342 | A | * | 1/1997 | Brey et al. | 324/322 |
| 5,616,540 | A | | 4/1997 | Lithgow et al. | 505/210 |
| 5,623,238 | A | | 4/1997 | Takahashi et al. | 333/204 |
| 5,629,266 | A | | 5/1997 | Lithgow et al. | 505/210 |
| 5,682,128 | A | | 10/1997 | Huang | 335/216 |
| 5,703,546 | A | | 12/1997 | Takahashi et al. | 333/204 |
| 5,710,105 | A | | 1/1998 | Shen | 505/210 |
| 5,914,296 | A | | 6/1999 | Shen | 505/210 |
| 6,060,882 | A | * | 5/2000 | Doty | 324/318 |
| 6,083,883 | A | | 7/2000 | Lithgow | 505/210 |
| 6,108,569 | A | | 8/2000 | Shen | 505/210 |
| 6,175,237 | B1 | * | 1/2001 | Doty et al. | 324/318 |
| 6,300,760 | B1 | * | 10/2001 | Schubert et al. | 324/248 |

OTHER PUBLICATIONS

Mehrdad Mehdizadeh, T. Koryu Ishii, James S. Hyde and Wojciech Froncisz, "Loop–Gap Resonator: A Lumped Mode Microwave Resonant Structure," IEEE Trans. Microwave Theory Tech., vol. MTT–31, pp. 1059–1063, Dec. 1983.

M.J. Lancaster, F. Huang, A. Porch, B. Avenhaus, J.S. Hong, and D. Hung, "Miniature Superconducting Filters," IEEE trans. Microwave & RF, Theory Tech., vol. 44, No. 7, pp. 1339–1346, 1996.

Patricia Jezek, Hai Tran, and T. Koryu Ishii, "Strip–ring Resonator Makes Harmonics–Rich Oscillator," Microwaves & RF, Jun. 1984.

Wang et al., "Radio–Frequency Losses of $YBa_2CU_3\ O_{7-5}$ Composite Superconductors," Supercond. Sci. Technol. 1:24–26 (1988).

W.N. Hardy and L.A. Whitehead, "Split–ring Resonator for Use in Magnetic Resonance from 200–2000 MHz," Rev. Sci, Instrum. 52(2), Feb. 1981.

* cited by examiner

THIN FILM RESONATORS

TECHNICAL FIELD

The present disclosure relates generally to electromagnetic resonators, and more particularly, to microstrip electromagnetic resonators.

BACKGROUND ART

Conventional resonant cavity filters consist of an outer housing made of an electrically conductive material and one or more resonant elements, or resonators, are mounted inside the housing. The resonators may be mounted within the cavity using, for example, a dielectric material. Electromagnetic energy is coupled through a first coupling mechanism in the housing to a first resonator and then to any additional resonators in the housing. A second coupling mechanism is used to output the electromagnetic energy from the housing.

Resonators are often used in filters to pass or reject certain signal frequencies. The particular design, shape, materials and spacing of the housing, the resonant elements, and the apertures between resonant elements determine the signal frequencies passed through the filter, as well as the insertion loss of the filter and quality factor ("Q") of each resonator. Ideally, resonators should have minimum signal loss in their passbands.

Resonators generally consist of conductive structures, and are typically of either a two-dimensional type, or a three-dimensional type. Two-dimensional resonators, also known as microstrip resonators, are formed by depositing a conductive layer onto a substrate and removing some of the conductive material from the substrate to leave a length of conductive material behind. The length of conductive material remaining on the substrate forms one or more resonators. Two-dimensional resonators are commonly referred to as thin film resonators.

Thin film resonator technology has been used to produce high performance military and commercial wireless devices. One type of two-dimensional resonators uses a thin film of high temperature superconductive (HTS) material disposed onto a dielectric substrate. One major problem associated with the fabrication of thin film resonators is the variation in the thickness of the dielectric substrate. Thickness of the dielectric substrate influences not only the coupling coefficient between adjacent resonators, but also affects the resonant frequency of the resonator. Accordingly, variations in the thickness of the dielectric substrate also results in the variations in the resonant frequency of the thin film resonator.

The velocity of an electromagnetic wave in a microstrip is given by Equation 1.

$$v_p = \frac{c}{\sqrt{\varepsilon_e}} \qquad \text{Equation 1}$$

Where c is the velocity of light in free space and $\epsilon_e$ is the effective dielectric constant of the microstrip. The effective dielectric constant of the microstrip can be approximated by Equation 2.

$$\varepsilon_e \approx \frac{1+\varepsilon_r}{2} + \left[\frac{\varepsilon_r - 1}{2}\right]\left[1 + 10\frac{h}{w}\right]^{-\frac{1}{2}} \qquad \text{Equation 2}$$

Where $\in_r$ is the dielectric constant of the substrate, h is the thickness of the substrate, and w is the width of the microstrip. As can be seen from Equations 1 and 2, when h increases, $\in_e$ decreases and, therefore, $\upsilon_p$ increases. As a result, the resonant frequency of the microstrip resonator increases as well. In practice, it is not uncommon for even the most precisely fabricated substrates to vary in thickness by as much as ±1%.

Due to such dependence of the resonant frequency on the thickness of the substrate, the measured frequency response of such a microstrip resonator usually deviates from the frequency response for which the resonator is designed. Tuning of filters designed using such resonators is a very tedious task even for experienced filter engineers, because one has to tune not only the coupling coefficient between the resonators but also the resonant frequency of the individual resonators.

Another issue pertinent to thin film filters is the miniaturization of the resonator structure used to design such filters. As the resonant frequency of a microstrip resonator decreases, and, therefore, the resonant wavelength increases, it is necessary to use larger size microstrip resonators, which necessitates the use of bulky resonators to achieve lower resonant frequencies. Substantial effort has been devoted to the miniaturization of the resonator structures. FIG. 1 shows some exemplary thin film resonator structures that have been used in filters. In FIG. 1, reference numeral 12 refers to a standard microstrip resonator, reference numeral 14 refers to a loop resonator formed by removing the central portion from the standard microstrip resonator 12 and reference numeral 16 refers to a capacitively loaded loop resonator. Further, reference numeral 18 refers to an open loop resonator, reference numeral 20 refers to a meander shaped open loop resonator, and reference numeral 22 refers to a folded open loop resonator.

BRIEF DESCRIPTION OF THE DRAWINGS

The present patent is illustrated by way of example and not limitations in the accompanying figures, in which like references indicate similar elements, and in which.

DETAILED DESCRIPTION

Figure 2:
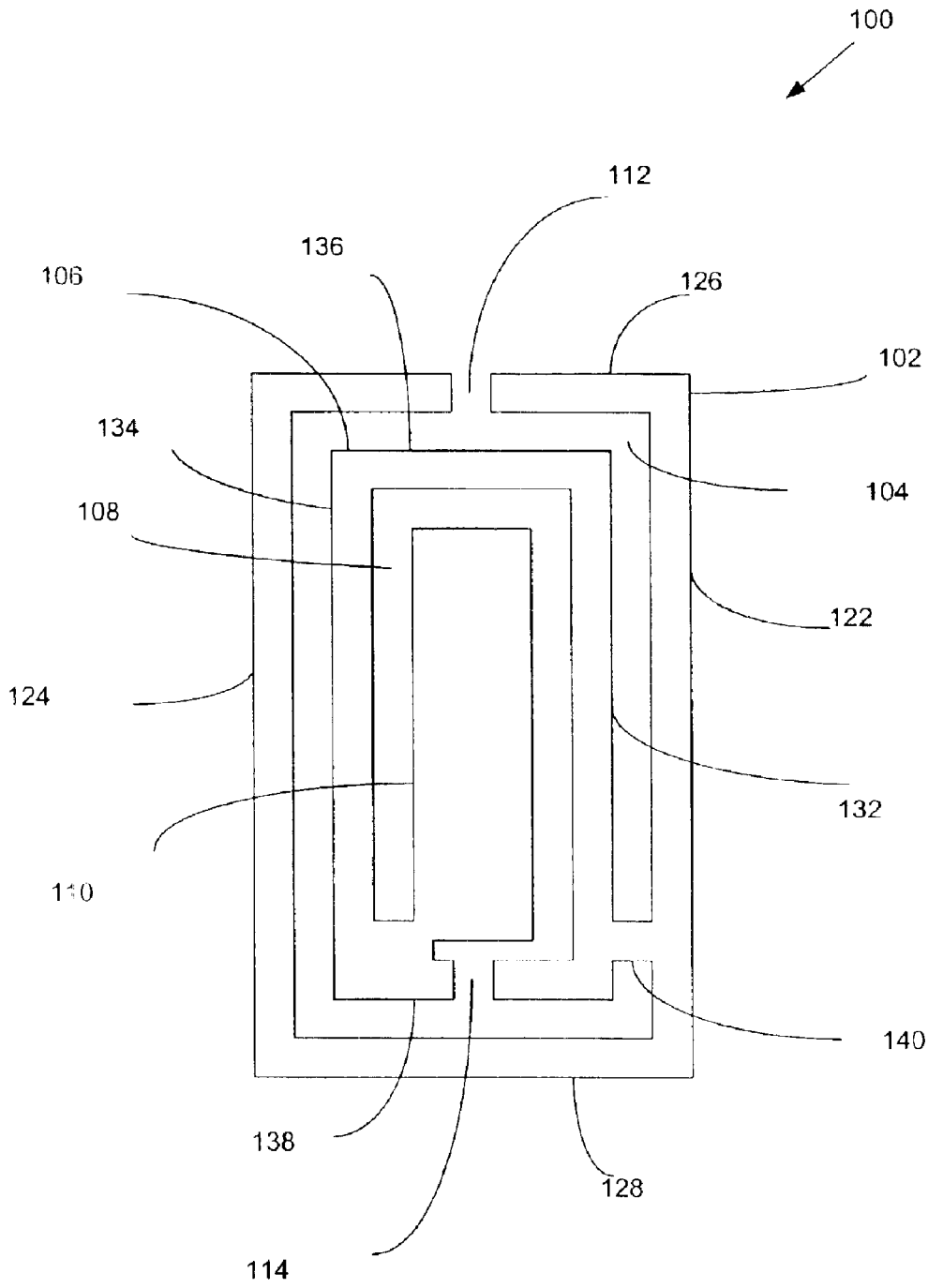
FIG. 2 is an exemplary illustration of a resonator comprising two open loops and a filled microstrip.

As disclosed in detail hereinafter, a resonator is provided which integrates a microstrip resonator structure and a coplanar resonator structure. FIG. 2 illustrates an exemplary resonator 100 including a first outer loop 102, a first open slot 104, a first inner loop 106 and a second open slot 108. The first open slot 104 is located within the first outer loop 102. Similarly, the second open slot 108 is located within the first inner loop 106. The resonator 100 further includes a first rectangular strip 110 located within the second open slot 108.

The first outer loop 102 of the resonator 100 includes a first opening 112, while the first inner loop 106 of the resonator 100 includes a second opening 114. The first outer loop 102 and the first inner loop 106 of the resonator 100 illustrated in FIG. 2 may be fabricated from high temperature superconductive materials, such as YBa2Cu3O7-δ. However, in an alternate embodiment of the resonator 100, the first outer loop 102 and the first inner loop 106 may be made of any other conductive material used in building microstrip resonators. In the embodiment of the resonator 100 shown in FIG. 2, the first outer loop 102 and the first inner loop 106 are of rectangular shape. However, in an alternate embodiment of the resonator 100, the first outer loop 102 and the first inner loop 106 may be made in any other shapes desired, such as, triangular, circular, etc.

The first outer loop 102 of the resonator 100 illustrated in FIG. 2 includes a first longer side 122, a second longer side 124, a first shorter side 126 and a second shorter side 128. The first inner loop 106 of the resonator 100 illustrated in FIG. 2 includes a third longer side 132, a fourth longer side 134, a third shorter side 136 and a fourth shorter side 138. In the exemplary embodiment of the resonator 100 illustrated in FIG. 2, the first opening 112 is located on the first shorter side 126, however, in an alternate arrangement, the first opening 112 may be located on any other side of the first outer loop 102. Similarly, in the exemplary embodiment of the resonator 100 illustrated in FIG. 2, the second opening 114 is located on the fourth shorter side 138. However, in an alternate arrangement, the second opening 114 may be located on any other side of the inner loop 106.

In the exemplary resonator 100 of FIG. 2, the first rectangular strip 110 is connected to the inner loop 106 on the fourth shorter side 138. The resonator 100 further includes a shunting microstrip 140 that connects the first outer loop 102 to the first inner loop 106. In the exemplary embodiment of the resonator 100, the shunting microstrip is located between the first longer side 122 and the third longer side 132. However, in an alternate arrangement, the shunting microstrip may be located in any alternate location between the first outer loop 102 and the first inner loop 106. The separation of the first outer loop 102 from the first inner loop 106 by the first open slot 104 and the separation of the first inner loop 106 from the first rectangular strip 110 by the second open slot 108 gives the resonator 100 a coplanar structure.

In the exemplary implementation of the resonator 100, the width of the first outer loop 102 and the first inner loop 106 is 200 micrometers ($\mu$m), while the width of the first open slot 104 and the second open slot 108 is 100 $\mu$m. However, alternate width for the first outer loop 102, the first inner loop 106, the first open slot 104 and the second open slot 108 may be provided. In the exemplary implementation, the outer dimensions of the resonator 100 are 1.7 mm by 7 mm, accordingly, in this implementation of the resonator 100, the length of the first longer side 122 is 7 mm and the length of the first shorter side 126 is 1.7 mm. Also in the embodiment of the resonator 100 illustrated in FIG. 2, the width of the first rectangular strip 110 is 500 $\mu$m.

The exemplary embodiment of the resonator 100 of FIG. 2 is located on a substrate of Magnesium Oxide (MgO) having the permittivity of 9.6 and a thickness varying between 0.2 mm and 2 mm. However, in an alternate arrangement, the resonator 100 of FIG. 2 may be located on any of the alternate dielectric substrate material commonly used in the industry.

The thickness of the substrate on which the resonator 100 is located influences the resonant frequency of the resonator 100. As explained above with respect to Equations 1 and 2, the resonant frequency of the resonator 100 increases as the thickness of the substrate increases due to increase in the effective dielectric constant $\in_e$ of the substrate. The coplanar structure of the resonator 100 gives rise to stray capacitance between various microstrips. For example, there is stray capacitance between the first outer loop 102 and the first inner loop 106. Similarly, there is stray capacitance between the first between the microstrips increases when the thickness of the substrate increases. The increase in the stray capacitance between the microstrips of the resonator 100 results in a decrease in the resonant frequency of the resonator 100. This effect of decrease in the resonant frequency of the resonator 100 due to increase in the thickness of the substrate due to the stray capacitance of the resonator 100 is opposite to the effect of increase in the resonant frequency of the resonator 100 upon an increase in the thickness of the substrate due to the change in effective dielectric constant $\in_e$ of the substrate. Accordingly, by properly trading off the increasing and decreasing capacitances that occur as substrate thickness varies, the resonant frequency of the resonator may be made relatively immune to substrate thickness variations.

The amount of stray capacitance between various microstrips of the resonator 100 depends on the width of the first open slot 104 and the width of the second open slot 108, as well as on the location of the shunting microstrip 140. In the exemplary illustration of the resonator 100, where the thickness of the substrate may vary between 0.5 mm and 0.51 mm, the shunting microstrip 140 may be located at a distance of 1.4 mm from the outer edge of the second shorter side 128. However, for different thickness of the substrate, the shunting microstrip 140 may be located at a different location in the resonator 100.

Figure 3:
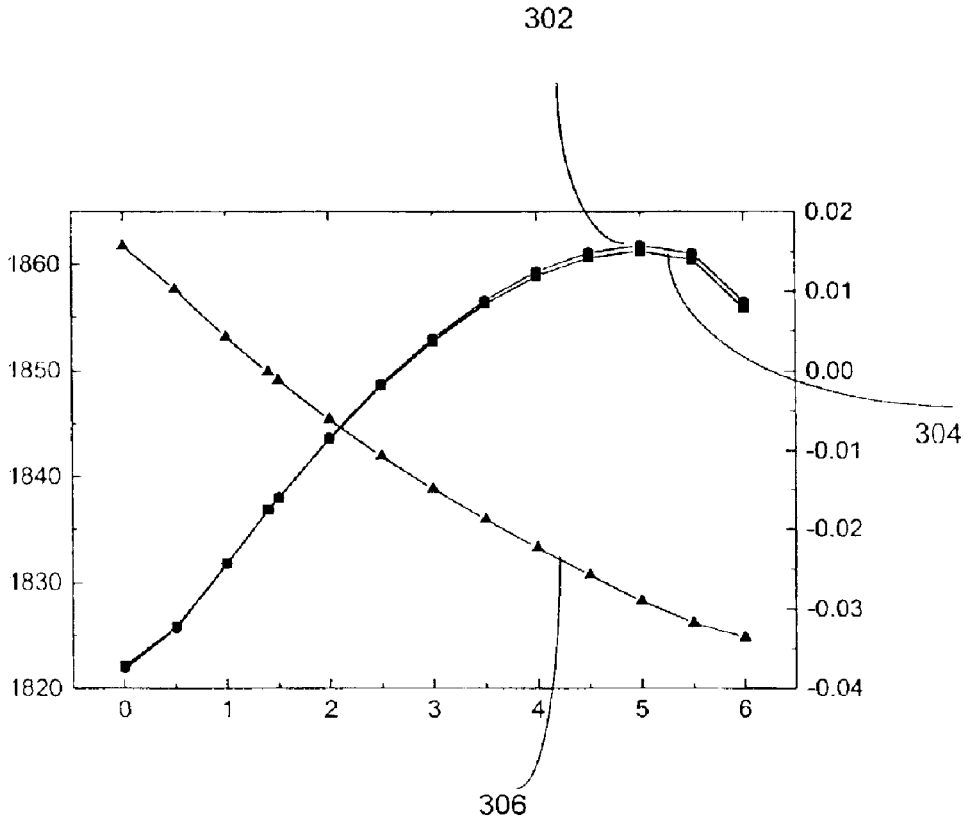
FIG. 3 is an exemplary plot illustrating of the resonant frequencies of the resonator of FIG. 2 for various shunting arrangements.

FIG. 3 is an exemplary plot illustrating of the resonant frequencies of the resonator 100 of FIG. 2 as a function of the location of the shunting microstrip 140 from the outer edge of the second shorter side 128. The resonant frequencies of the resonator 100 illustrated in FIG. 3 are measured for the thickness of the substrate on which the resonator 100 is located being equal to 0.5 mm and 0.51 mm. In FIG. 3, the horizontal axis indicates the distance of the shunting microstrip 140 from the outer edge of the second shorter side 128. The vertical axis on the left-hand side indicates the resonant frequency of the resonator 100. The line 302 in FIG. 3 shows the resonant frequency of the resonator 100 for various distances of the shunting microstrip 140 from the outer edge of the second shorter side 128 when the thickness of the substrate is equal to 0.5 mm, while the line 304 shows the resonant frequency of the resonator 100 at various distances of the shunting microstrip 140 from the outer edge of the second shorter side 128 when the thickness of the substrate is equal to 0.51 mm. In FIG. 3 the vertical axis on the right-hand side indicates the percent change in the resonant frequency between the 0.5 mm and the 0.51 mm substrate thicknesses. The line 306 in FIG. 3 shows the percentage change in the resonant frequency of the resonator 100 when the substrate thickness changes from 0.5 mm to 0.51 mm for various distances of the shunting microstrip 140 from the outer edge of the second shorter side 128.

As can be seen from the FIG. 3, when the distance of the shunting microstrip 140 from the outer edge of the second shorter side 128 is equal to 1.4 mm, the same resonant frequency is obtained for the resonator 100 at the substrate thickness of 0.5 mm and 0.51 mm. This indicates that when the shunting microstrip 140 is located at distance of 1.4 mm from the outer edge of the second shorter side 128 in the resonator 100, the increase on the resonant frequency of the resonator 100 due to the increase in the thickness of the substrate from 0.5 mm to 0.51 mm is offset by the decrease in the resonant frequency of the resonator 100 due to the stray capacitance between various microstrips of the resonator 100.

Figure 1:
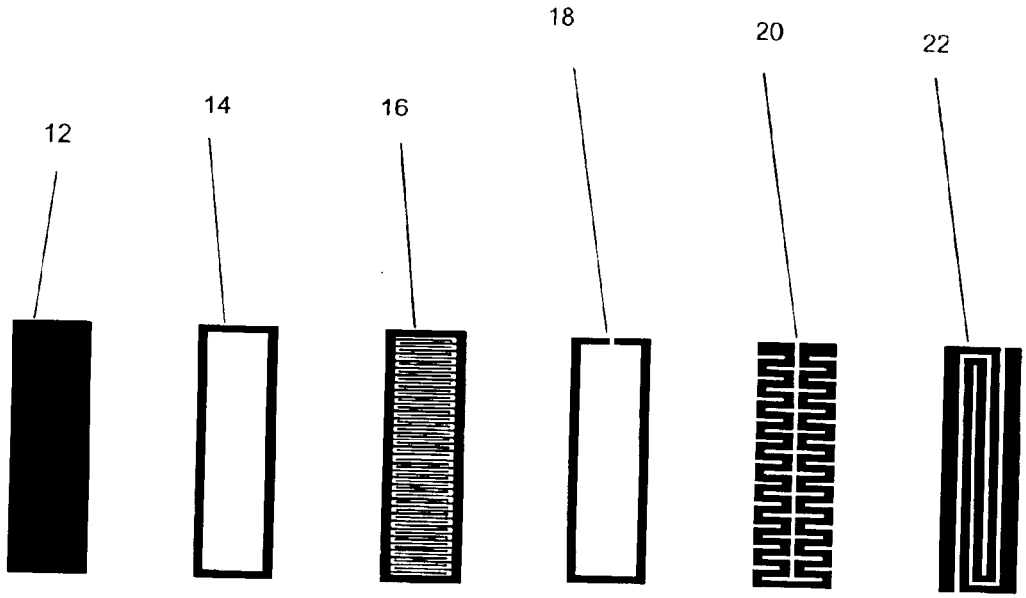
FIG. 1 (PRIOR ART)
FIG. 1 shows various exemplary thin film resonator structures used in filters.

Another advantage of the resonator 100, is that, due to the stray capacitance between various microstrips, for a given size, the resonator 100 may be used at much lower resonant frequencies than the conventional resonators illustrated in FIG. 1. In other words, to achieve a given resonant frequency, the resonator 100 may be designed to have a much smaller size than the conventional resonators described in FIG. 1.

The compact nature of the resonator 100 is illustrated in Table 1, which shows the resonant frequencies for the various resonator types described in FIG. 1 and FIG. 2. For this illustration, each of these resonators is constructed to have the dimension of 1.4 mm by 7 mm and they are deposited on an MgO substrate of the thickness of 0.5 mm. Column B in the Table 1 indicates the resonant frequency for the specific resonator listed in Column A. While Column C indicates the resonant frequency listed in Column B as a percentage of the resonant frequency of the microstrip resonator 12 described in FIG. 1.

TABLE 1

| Resonator Type | Resonant Frequency (MHz) | Percentage Resonant Frequency (%) |
|---|---|---|
| Standard Microstrip Resonator 12 | 7539 | 100 |
| Loop Resonator 14 | 7330 | 97.2 |
| Capacitively Loaded Loop Resonator 16 | 6107 | 81 |
| Open Loop Resonator 18 | 3810 | 50.5 |
| Meander Open Loop Resonator 20 | 2355 | 31.2 |
| Folded Open Loop Resonator 22 | 1932 | 25.6 |
| Shunted Open Loop Resonator 100 | 1822 | 24.1 |

As shown in Table 1, the resonator 100 can achieve a resonant frequency which is only 24.1% of the resonant frequency of the microstrip resonator 12. This property of the resonator 100 allows it to be used in building of smaller and less bulky filters that can operate at lower frequencies.

Figure 4:
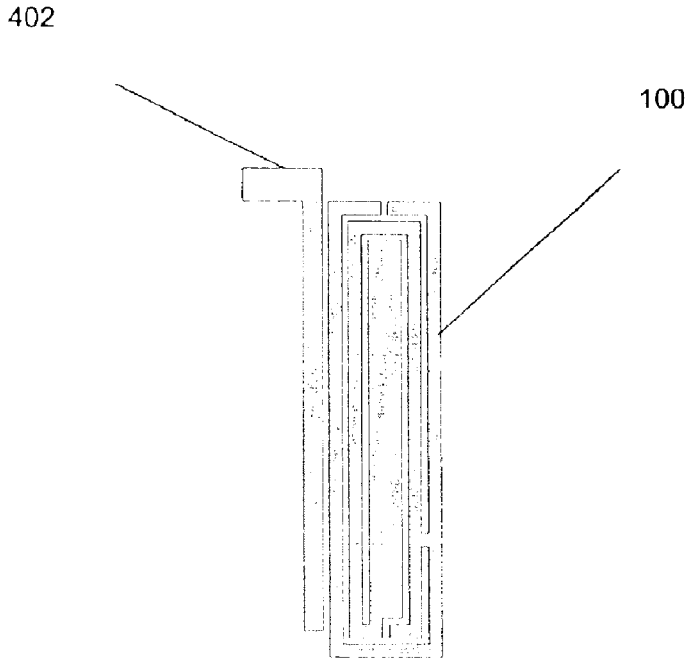
FIG. 4 is an exemplary illustration of the resonator of FIG. 2 further comprising an input coupling microstrip.

FIG. 4 illustrates the resonator 100 of FIG. 2 with a coupling microstrip 402 that can be used as an input port. The coupling microstrip 402 is a microstrip of conducting material that can be connected to a signal input port. In the exemplary coupling arrangement illustrated in FIG. 4, the distance between the coupling microstrip 402 and the resonator 100 is 0.1 mm, however, in an alternate embodiment the coupling microstrip 402 may be located at a different distance from the resonator 100. The coupling strength (i.e., the loaded quality factor) of the coupling between the resonator 100 and the coupling microstrip 402 increases when the distance between the coupling microstrip 402 and the resonator 100 decreases. The coupling strength is also a function of the length of the coupling microstrip 402. For example, in the illustrated embodiment of FIG. 4, the loaded quality factor of the coupling arrangement for various lengths of the coupling microstrip 402 is as listed below in Table 2.

TABLE 2

| Length of the Coupling Microstrip | Loaded Quality Factor |
|---|---|
| 1.0 | 1450 |
| 2.0 | 471 |
| 3.0 | 229 |
| 4.0 | 137 |
| 5.0 | 91.5 |
| 6.0 | 65.4 |
| 7.0 | 49.6 |

Figure 5A:
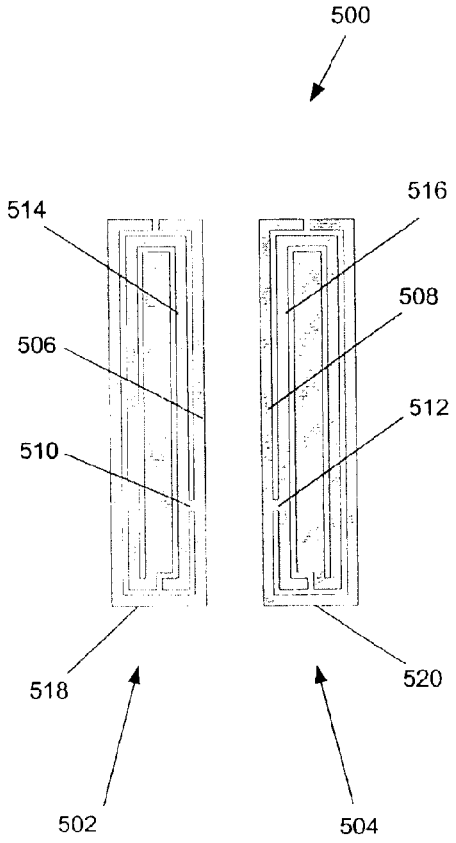
FIGS. 5A and 5B illustrate two alternate exemplary coupling configurations used in designing multi-pole filters using the resonator of FIG. 2.
Figure 5B:
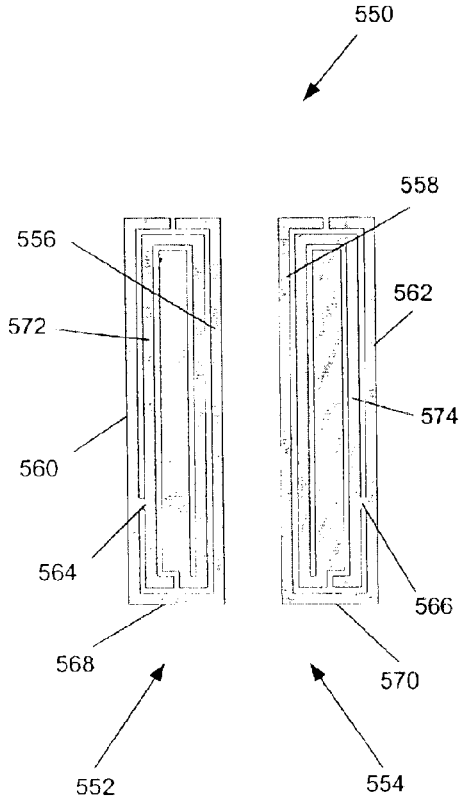

FIGS. 5A and 5B illustrate two alternate coupling configurations used in designing multipole filters using the resonator 100 of FIG. 2. FIG. 5A illustrates a coupling arrangement 500 of two resonators 502 and 504 where the first longer side 506 of resonator 502 is adjacent to the first longer side 508 of resonator 504. In this configuration each of the first longer sides 506 and 508 that are shunted by shunting microstrips 510 and 512 to the inner loops 514 and 516 are adjacent to each other. FIG. 5B illustrates a coupling arrangement 550 of two resonators 552 and 554 where the second longer side 556 of resonator 552 is adjacent to the second longer side 558 of resonator 554. In this configuration each of the first longer sides 560 and 562 which are shunted by microstrips 564 and 566 to the inner loops 572 and 574 are not adjacent to each other.

Figure 6:
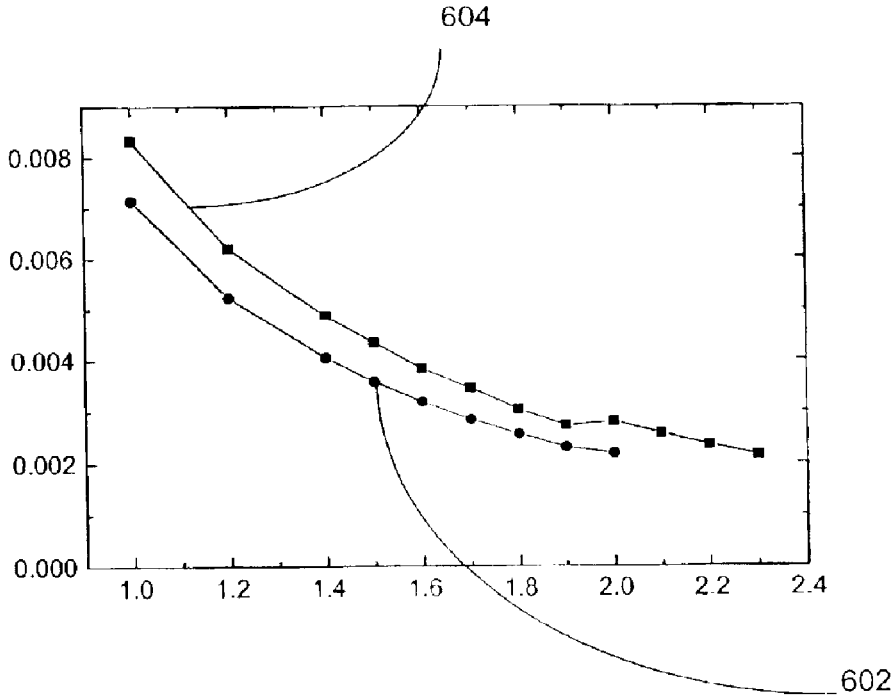
FIG. 6 is an exemplary plot illustrating the coupling coefficients as a function of the distance between the resonators for the two coupling configurations illustrated in FIGS. 5A and 5B.

FIG. 6 illustrates the coupling coefficients as a function of the distance between the resonators for various coupling configurations illustrated in FIGS. 5A and 5B. In FIG. 6, the horizontal axis indicates the distance between the resonators 502 and 504 in FIG. 5A and the distance between the resonators 552 and 554 in FIG. 5B. The vertical axis in FIG. 6 indicates the coupling coefficients between the resonators for the coupling configurations illustrated in FIGS. 5A and 5B. The line 602 illustrates the coupling coefficients between the resonators 502 and 504 of FIG. 5A for various distances between the resonators 502 and 504. The line 604 illustrates the coupling coefficients between the resonators 552 and 554 of FIG. 5B for various distances between the resonators 552 and 554. For the illustration in FIG. 6, the distance of the shunting microstrip 510, 512, 564 and 566 from the second shorter sides 518, 520, 568 and 570 respectively, is assumed to be 1.4 mm.

As can be seen in FIG. 6, for the same distance between the resonators, the coupling arrangement depicted by line 604 and illustrated in FIG. 5B has a higher coupling coefficient than the coupling arrangement depicted by line 602 and illustrated in FIG. 5A.

Figure 7:
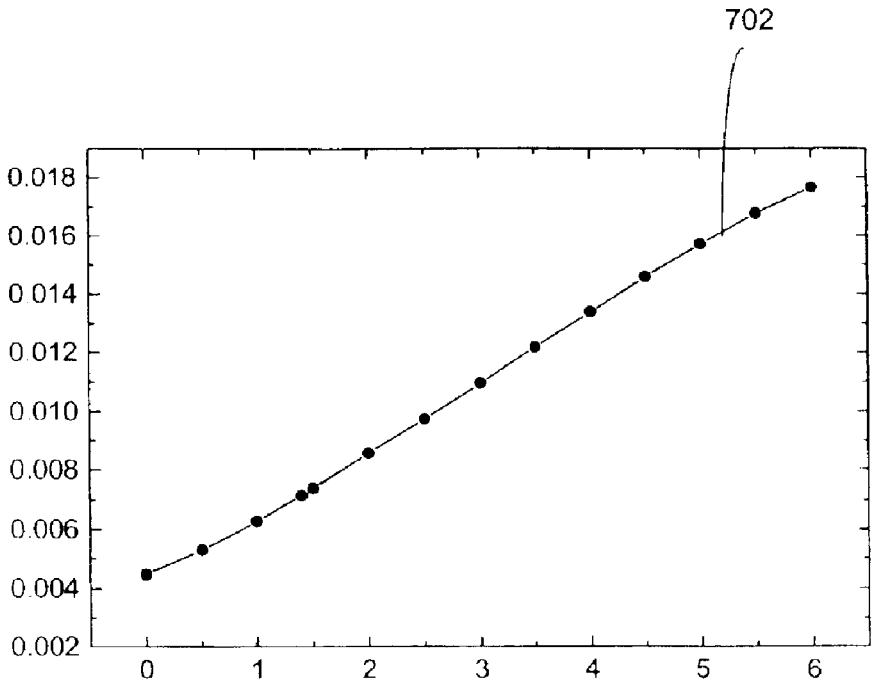
FIG. 7 is an exemplary plot illustrating the coupling coefficients as a function of the shunting position within the resonators for the coupling configuration illustrated in FIG. 5A.

FIG. 7 illustrates the coupling coefficients as a function of the shunting position within the resonators 502 and 504 for the coupling configuration illustrated in FIG. 5A. In FIG. 7, the horizontal axis indicates the distance between the shunting microstrips 510 and the second shorter side 518 of the resonator 502, and between the shunting microstrip 512 and the second shorter side 520 of the resonator 504 of FIG. 5A. The vertical axis in FIG. 7 indicates the coupling coefficient between the resonators 502 and 504. For the illustration in FIG. 7 it is assumed that the distance between the resonators 502 and 504 is 1 mm. As can be seen from the line 702, the coupling coefficient between the resonators 502 and 504 increases as the distance of the shunting microstrips 510 and 512 from the second shorter sides 518 and 520 increases. Therefore, the coupling coefficients can be adjusted in a broad range by changing the distance of the shunting microstrips 510 and 512 from the second shorter sides 518 and 520, which allows for the realization of filters of wide bandwidth, as well as filters of narrow bandwidth where the resonators are nevertheless closely spaced.

Figure 8:
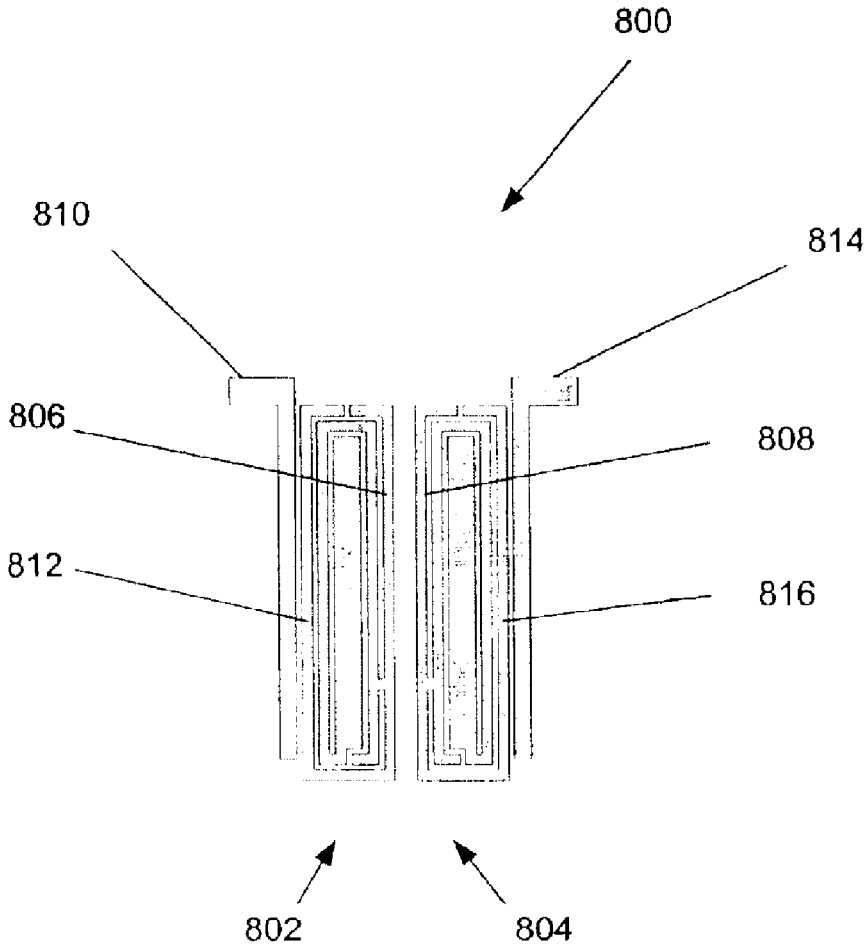
FIG. 8 illustrates an exemplary layout of a two-pole filter using the resonator of FIG. 2.

FIG. 8 illustrates an exemplary layout of a two-pole filter 800 using two resonators similar to the resonator 100 illustrated in FIG. 2. In FIG. 8 two resonators 802 and 804 are located adjacent to each other such that the distance between a first longer side 806 of resonator 802 and a first longer side 808 of filter 804 is 0.4 mm. The two-pole filter of FIG. 8 also includes a first coupling microstrip 810 adjacent to a second longer side 812 of the resonator 802 and a second coupling microstrip 814 adjacent to a second longer side 816 of the resonator 804. Note that the arrangement of the resonators 802 and 804 adjacent to each other is similar to that illustrated in FIG. 5A. In the two-pole filter 800 illustrated in FIG. 8, the lengths of the first coupling microstrip 810 and the second coupling microstrip 814 are both 6.6 mm. In the two-pole filter illustrated in FIG. 8, the distances of the coupling microstrips 810 and 814 from the resonators 802 and 804 are 0.1 mms respectively.

Figure 8A:
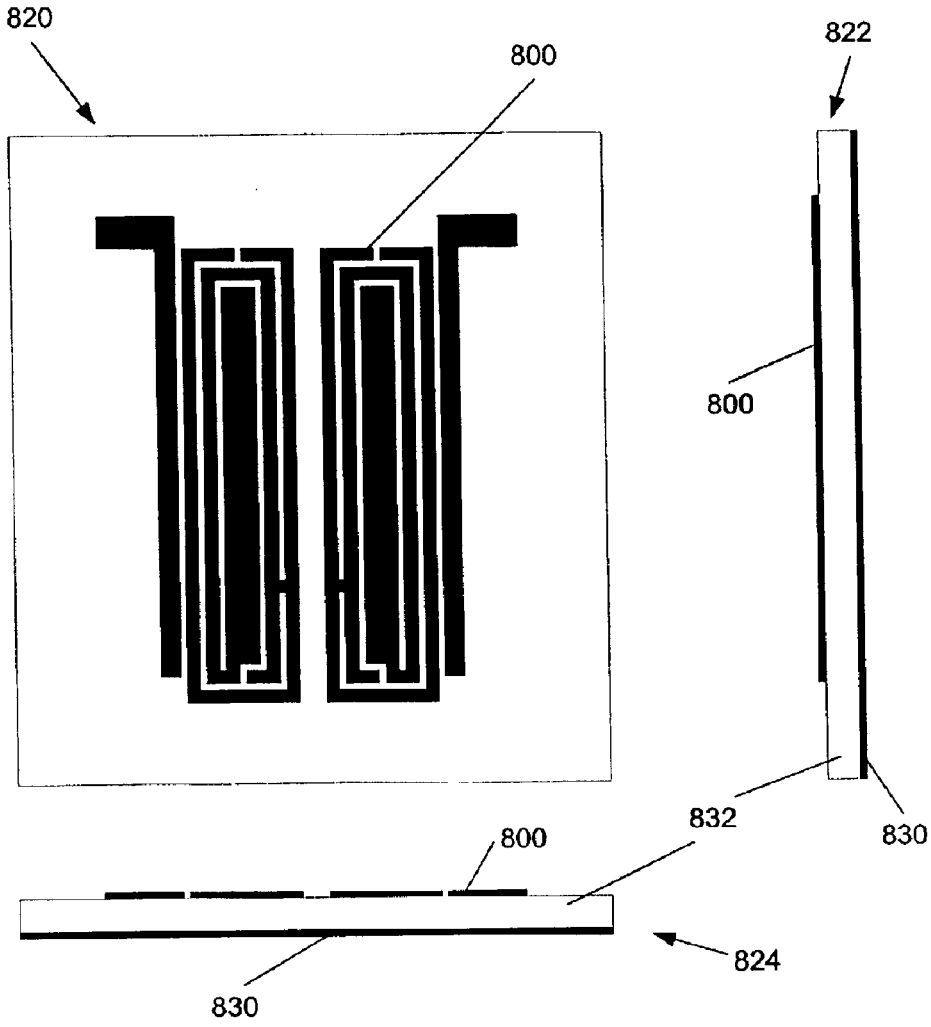
FIG. 8A illustrates an exemplary implementation of the two-pole filter of FIG. 8 on a substrate.

FIG. 8A illustrates an exemplary implementation of the two-pole filter 800 on a substrate. In this exemplary implementation, 820 illustrates the top-view of the two-pole filter 800, 822 illustrates the side-view of the two-pole filter 800, and 824 illustrates the front-view of the two-pole filter 800. The HTS ground plane 830 may be made of any of the commonly used HTS material such as YBa2Cu3O7-δ or metals such as gold. The substrate 832 may be made of any of the commonly used substrate material such as MgO, sapphire and LaAlO3.

Figure 8B:
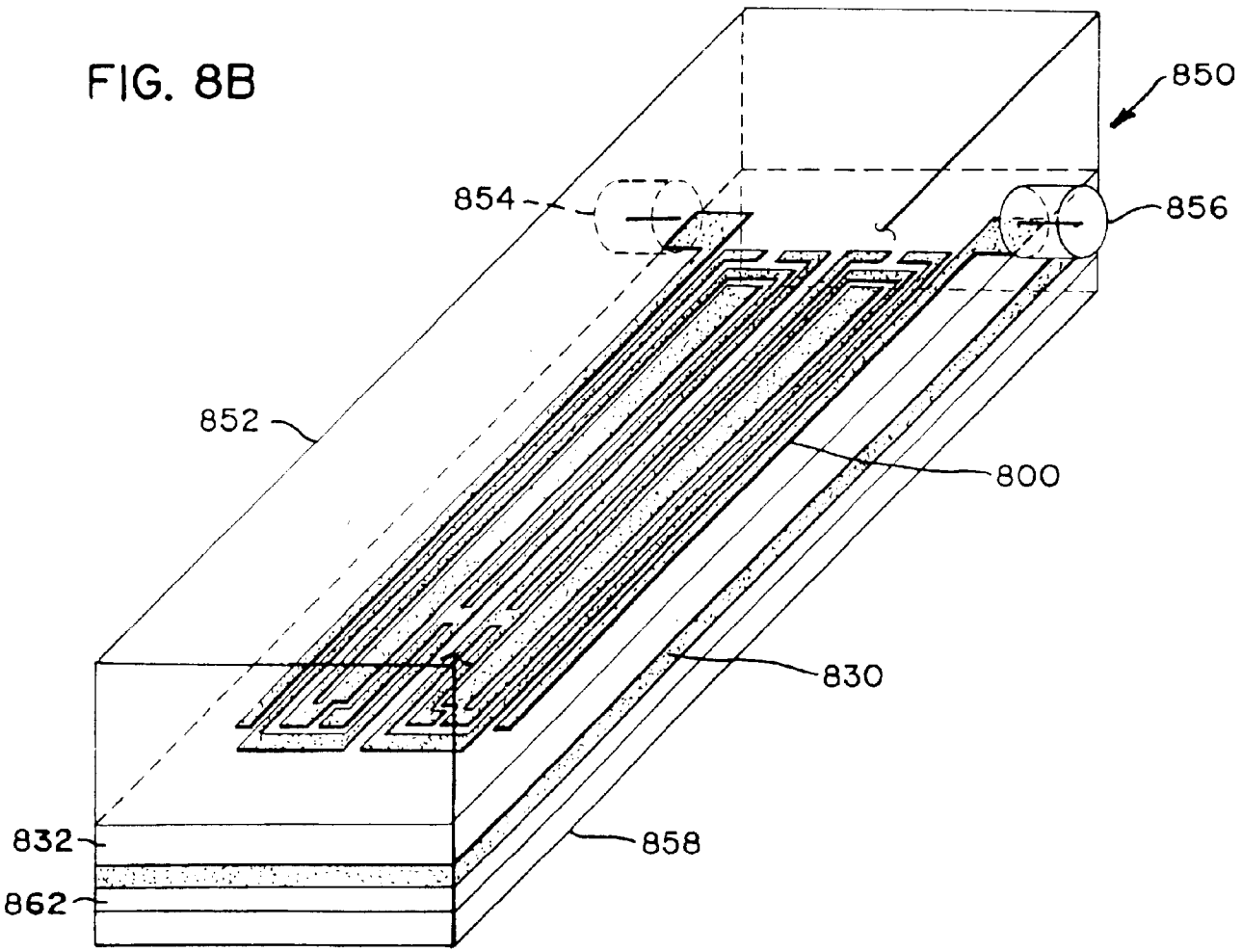
FIG. 8B illustrates a three dimensional implementation of the two-pole filter of FIG. 8 in a metallic housing.

FIG. 8B illustrates a three dimensional implementation 850 of the two-pole filter 800 in a metallic housing. The metallic housing 852 may be made of any of the commonly used metal such as aluminum. 854 and 856 are coaxial cable connectors used to couple energy in and out of the two-pole filter 800. The bottom layer 858 of the metallic housing is made of any of the carrier material such as titanium alloy. The HTS ground plane is coated by an additional metal layer 862 made of a metal such as gold for improvement of electrical and thermal conductivity.

Figure 9:
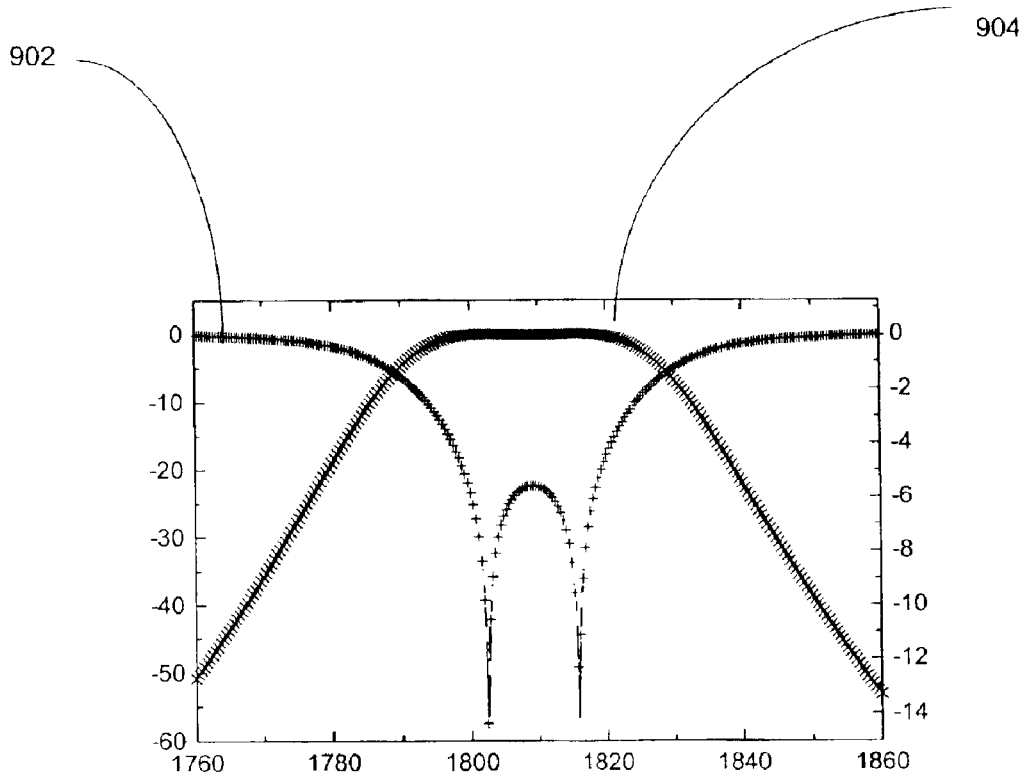
FIG. 9 is an exemplary plot illustrating a frequency response of the exemplary two-pole filter of FIG. 8.

FIG. 9 illustrates a frequency response of the exemplary two-pole filter 800 illustrated in FIG. 8. The horizontal axis in FIG. 9 indicates the frequency in MHz, the left-hand side vertical axis indicates the return loss in decibels (dB) and the right-hand side vertical axis indicates the insertion loss in dBs. The graph depicted by the line 902 shows the return loss characteristics of the two-pole filter illustrated in FIG. 8, and the graph depicted by the line 904 shows the insertion loss characteristics of the two-pole filter illustrated in FIG. 8. As can be seen from the frequency response in FIG. 9, the passband center, the bandwidth and the passband ripple of the filter of FIG. 8 are 1809.2 MHz, 18.8 MHz and 0.026 dB respectively.

Figure 10:
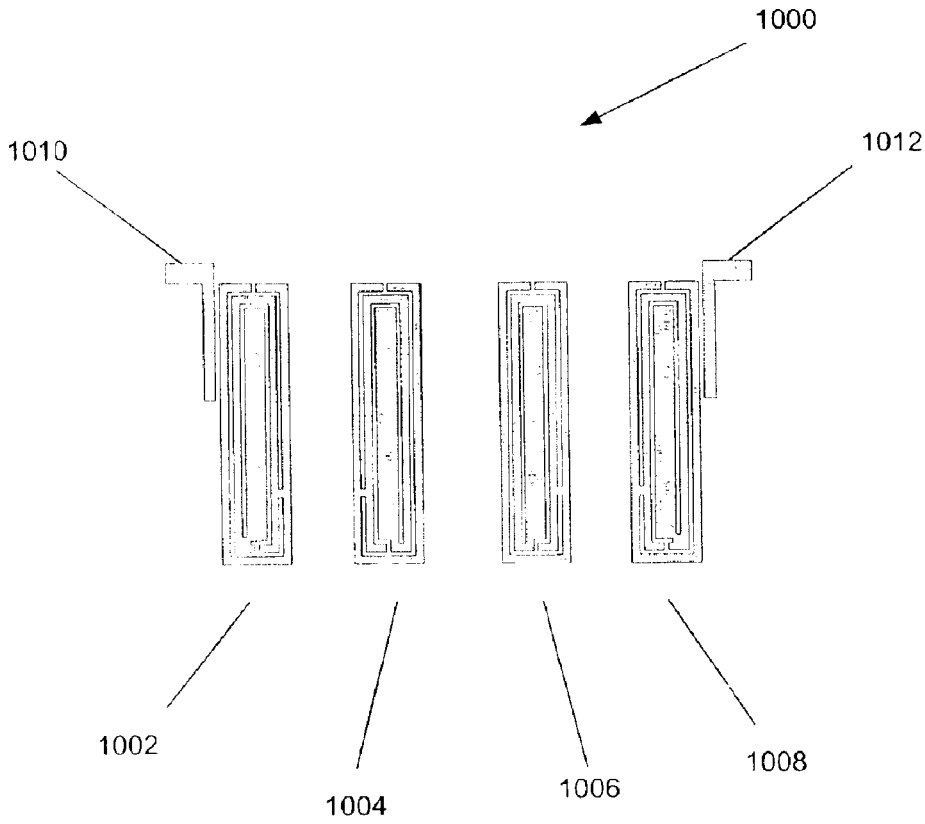
FIG. 10 illustrates an exemplary layout of a four-pole filter using the resonator of FIG. 2.

FIG. 10 illustrates an exemplary layout of a four-pole filter 1000 using four resonators similar to the resonator 100 illustrated in FIG. 2. In FIG. 10 four resonators 1002, 1004, 1006 and 1008 are located adjacent to each other such that the gap between the resonators 1002 and 1004 is 1.5 mm, the gap between the resonators 1004 and 1006 is 1.9 mm, and the gap between the resonators 1006 and 1008 is 1.5 mm. The four-pole filter 1000 of FIG. 10 also includes a first coupling microstrip 1010 adjacent to the resonator 1002 and a second coupling microstrip 1012 adjacent to the resonator 1008. The lengths of the coupling microstrips 1010 and 1012 are 2.9 mm. In the four-pole filter 1000 illustrated in FIG. 10, the distances of the coupling microstrips 1010 and 1012 from the resonators 1002 and 1008 are 0.1 mm. In the embodiment illustrated in FIG. 10, the overall size of the four-pole filter 1000 is 7.4 mm by 14.3 mm.

Figure 11:
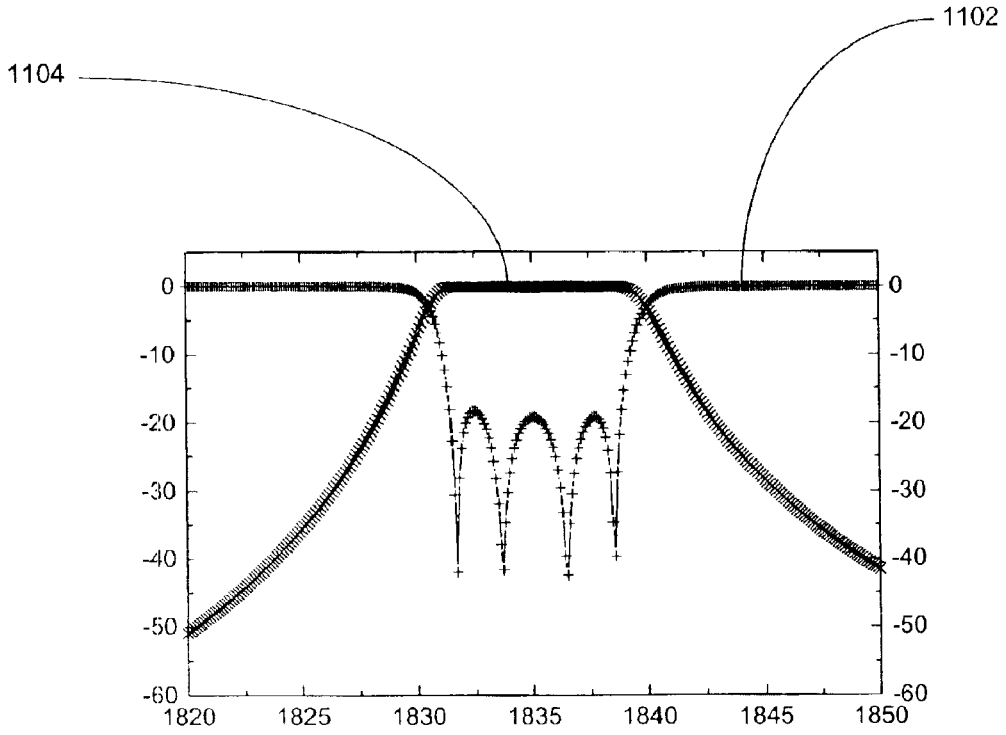
FIG. 11 is an exemplary plot illustrating a frequency response of the exemplary four-pole filter of FIG. 10.

FIG. 11 illustrates the frequency response of the exemplary four-pole filter 1000 illustrated in FIG. 10. The horizontal axis in FIG. 11 indicates the frequency in MHz, the left-hand side vertical axis indicates the return loss in dBs and the right-hand side vertical axis indicates the insertion loss in dBs. The graph depicted by 1102 shows the return loss characteristics of the four-pole filter 1000 illustrated in FIG. 10, while the graph depicted by 1104 shows the insertion loss characteristics of the four-pole filter 1000 illustrated in FIG. 10.

Figure 12:
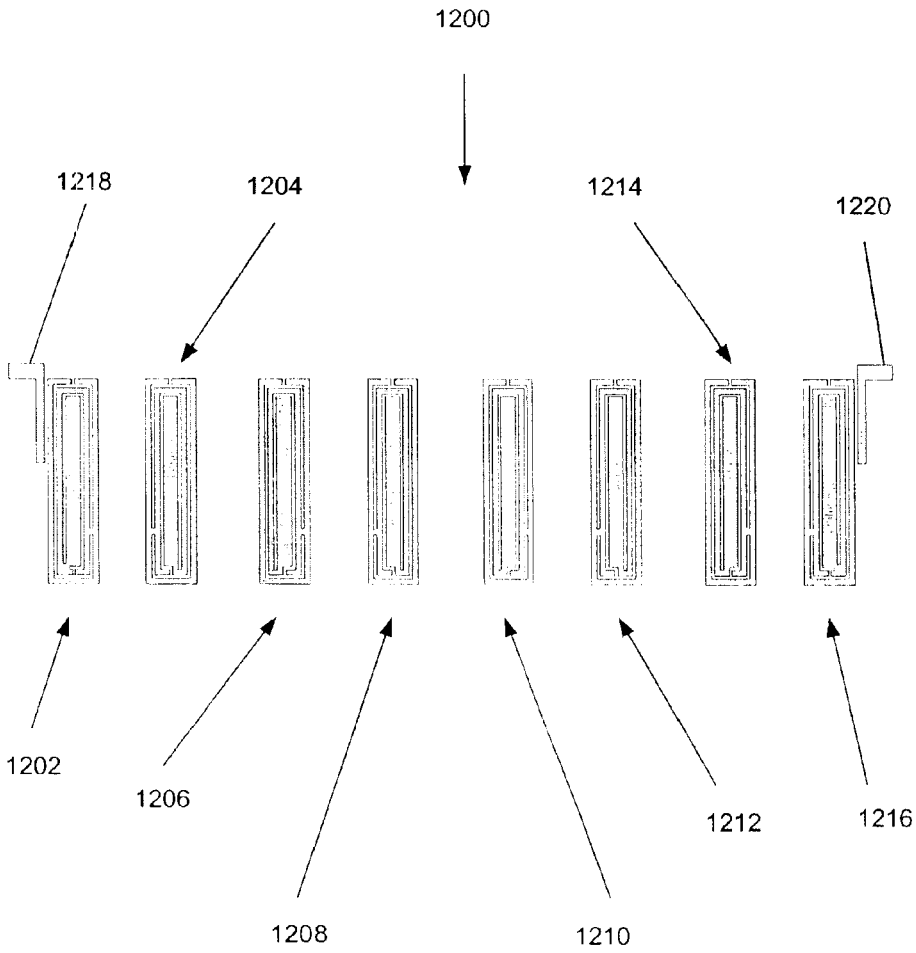
FIG. 12 illustrates an exemplary layout of an eight-pole filter using the resonator of FIG. 2.

FIG. 12 illustrates an exemplary layout of an eight-pole filter 1200 using eight resonators similar to the resonator 100 illustrated in FIG. 2. In FIG. 12 eight resonators 1202, 1204, 1206, 1208, 1210, 1212, 1214 and 1216 are located adjacent to each other such that the gap between the resonators 1202 and 1204 is 1.6 mm, the gap between the resonators 1204 and 1206 is 2.1 mm, the gap between the resonators 1206 and 1208 is 1.9 mm, the gap between the resonators 1208 and 1210 is 2.2 mm, the gap between the resonators 1210 and 1212 is 1.9 mm, the gap between the resonators 1212 and 1214 is 2.1 mm, and the gap between the resonators 1214 and 1216 is 1.6 mm. The eight-pole filter 1200 of FIG. 12 also includes a first coupling microstrip 1218 adjacent to the resonator 1202 and a second coupling microstrip 1220 adjacent to the resonator 1216. The lengths of the coupling microstrips 1218 and 1220 are 2.9 mm. In the eight-pole filter 1200 illustrated in FIG. 12, the distances of the coupling microstrips 1218 and 1220 from the resonators 1202 and 1216 are 0.1 mm. In the illustrated embodiment, the overall size of the eight-pole filter 1200 illustrated in FIG. 12 is 7.5 mm by 29.6 mm.

Figure 13:
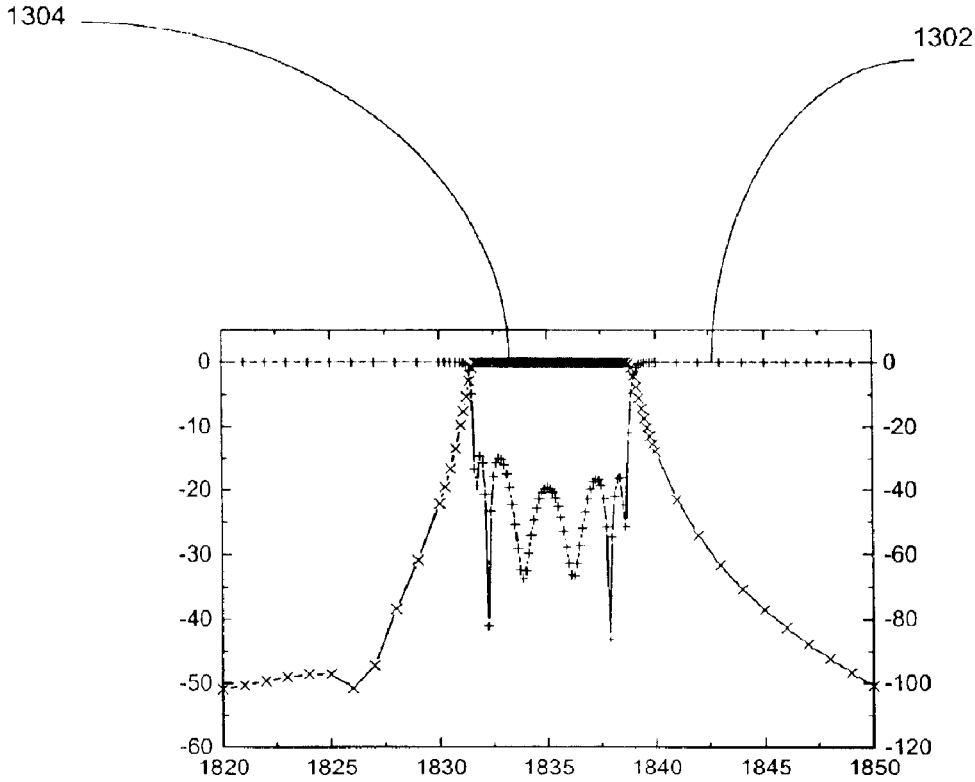
FIG. 13 is an exemplary plot illustrating a frequency response of the exemplary eight-pole filter of FIG. 12.

FIG. 13 illustrates the frequency response of the exemplary eight-pole filter 1200 illustrated in FIG. 12 where the eight-pole filter 1200 is located on a substrate of the thickness of 0.5 mm. The horizontal axis in FIG. 13 indicates the frequency in MHz, the left-hand side vertical axis indicates the return loss in dBs and the right-hand side vertical axis indicates the insertion loss in dBs. The graph depicted by 1302 shows the return loss characteristics of the eight-pole filter 1200 illustrated in FIG. 10, while the graph depicted by 1304 shows the insertion loss characteristics of the eight-pole filter 1200 illustrated in FIG. 12.

Figure 14:
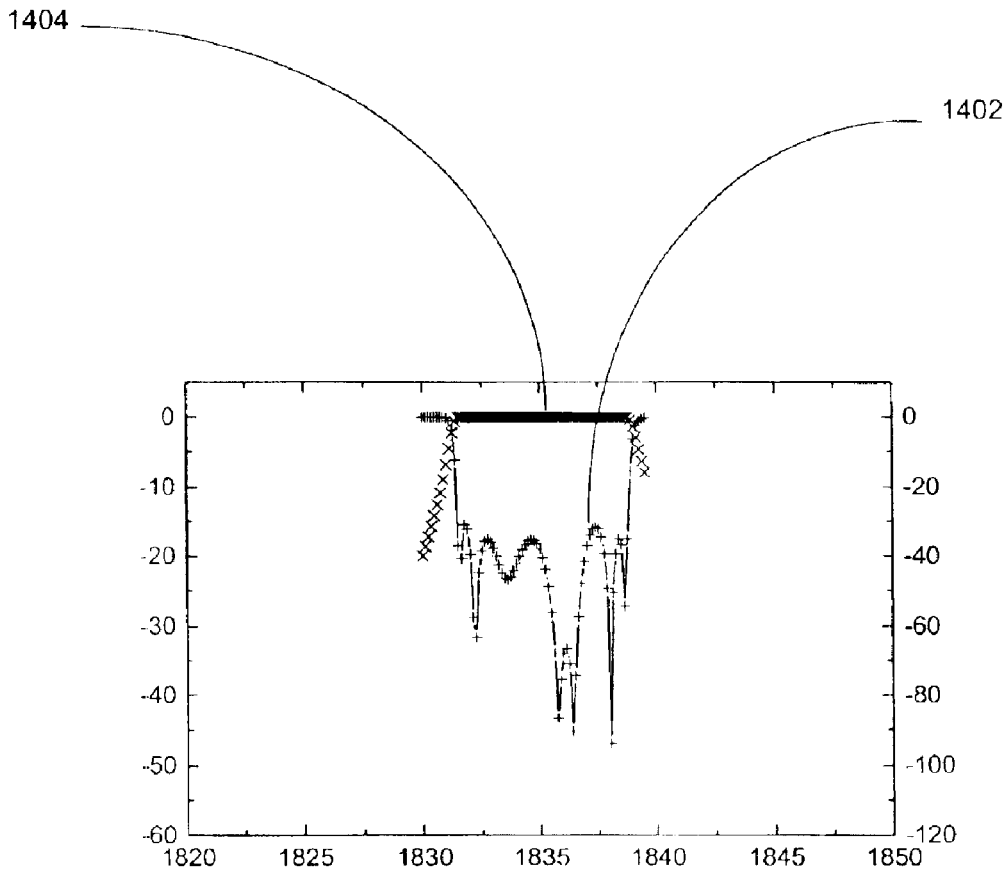
FIG. 14 is an exemplary plot illustrating another frequency response of the exemplary eight-pole filter of FIG. 12.

FIG. 14 illustrates the frequency response of the exemplary eight-pole filter 1200 illustrated in FIG. 12 where the eight-pole filter 1200 is located on a substrate of the thickness of 0.51 mm. The horizontal axis in FIG. 13 indicates the frequency in MHz, the left-hand side vertical axis indicates the return loss in dBs and the right-hand side y-axis indicates the insertion loss in dBs. The graph depicted by 1302 shows the return loss characteristics of the eight-pole filter 1200 illustrated in FIG. 10, while the graph depicted by 1004 shows the insertion loss characteristics of the eight-pole filter 1200 illustrated in FIG. 12.

Many modifications and variations may be made in the techniques and structures described and illustrated herein without departing from the spirit and scope of the present invention. Accordingly, it should be understood that the apparatus and systems described herein are illustrative only and are not limiting upon the scope of the present patent.

What is claimed is:

1. A thin film resonator having an outer loop of conductive element having a first open slot and an inner loop of conductive element having a second open slot and located in the first open slot, wherein:

the outer loop being of a rectangular shape comprising a first longer side, a second longer side, a first shorter side and a second shorter side, the first shorter side having a first opening in it;

the inner loop being of a rectangular shape comprising a third longer side adjacent to the first longer side of the outer loop, a fourth longer side adjacent to the second longer side of the outer loop, a third shorter side adjacent to the first shorter side of the outer loop, and a fourth shorter side adjacent to the second shorter side of the outer loop, the fourth shorter side having a second opening in it;

the inner loop further includes a fifth rectangular strip of conductive element in the second open slot; and the fifth rectangular strip of conductive element is connected to the fourth shorter side of the inner loop.

2. A filter comprising of a first thin film resonator as described in claim 1 adjacent to a second thin film resonator as described in 1.

3. The filter of claim 2 wherein the first longer side of the first thin film resonator is adjacent to the first longer side of the second thin film resonator.

4. The filter of claim 3, further comprising a first coupling microstrip adjacent to the second longer side of the first thin film resonator and a second coupling microstrip adjacent to the second longer side of the second thin film resonator.

5. The filter of claim 4 wherein the distance between the first thin film resonator and the second thin film resonator is approximately 0.4 mm, the length of the first coupling microstrip is 6.6 mm, and the length of the second coupling microstrip is approximately 6.6 mm.

6. The filter of claim 2 wherein the second longer side of the first thin film resonator is adjacent to the second longer side of the second thin film resonator.

7. The thin film resonator of claim 1 wherein the first longer side of the outer loop is connected to the third longer end of the inner loop by a shunting microstrip.

8. The thin film resonator of claim 7 wherein the shunting microstrip is made of a conductive element of a width of approximately 100 $\mu$m.

9. The thin film resonator of claim 7 wherein the shunting microstrip is located such that the thin film resonator has a stable resonant frequency over a range of thickness of the substrate.

10. The thin film resonator of claim 7 wherein the shunting microstrip is located at a distance of 1.4 mm from an inner edge of the second shorter side of the outer loop.

11. The thin film resonator of claim 1 further including a coupling microstrip adjacent to the thin film resonator.

12. The thin film resonator of claim 11 wherein the coupling microstrip is parallel to the second longer side of the outer loop.

13. The thin film resonator of claim 1 wherein the outer loop is made of a conductive element of a width of approximately 200 $\mu$m and the inner loop is made of a conductive element of a width of approximately 200 $\mu$m.

14. The thin film resonator of claim 1 wherein the inner loop and the outer loop are divided by a first gap of approximately 100 $\mu$m, and wherein the inner loop and the fifth rectangular strip are divided by a second gap of approximately 100 $\mu$m.

15. The thin film resonator of claim 1 wherein the fifth rectangular strip is made of a conductive element of a width of approximately 500 $\mu$m.

16. A filter comprising of a third thin film resonator as described in claim 1, a fourth thin film resonator as described in claim 1 adjacent to the third thin film resonator, a fifth thin film resonator as described in claim 1 adjacent to the fourth thin film resonator, and a sixth thin film resonator as described in claim 1 adjacent to the third thin film resonator.

17. A filter comprising of a third thin film resonator as described in claim 1, a fourth thin film resonator as described in claim 1 adjacent to the third thin film resonator, a fifth thin film resonator as described in claim 1 adjacent to the fourth thin film resonator, a sixth thin film resonator as described in claim 1 adjacent to the fifth thin film resonator, a seventh thin film resonator as described in claim 1 adjacent to the sixth thin film resonator, an eighth thin film resonator as described in claim 1 adjacent to the seventh thin film resonator, a ninth thin film resonator as described in claim 1 adjacent to the eighth thin film resonator, and a tenth thin film resonator as described in claim 1 adjacent to the ninth thin film resonator.

* * * * *

UNITED STATES PATENT AND TRADEMARK OFFICE

CERTIFICATE OF CORRECTION

PATENT NO. : 6,894,584 B2
APPLICATION NO. : 10/217273
DATED : May 17, 2005
INVENTOR(S) : Huai R. Yi It is certified that error appears in the above-identified patent and that said Letters Patent is hereby corrected as shown below:

On the Title Page (73) Assignee, delete "Isco" and insert --ISCO--.

Col. 9, Ln 46-48
Delete Claim 6

Col. 10, Ln 8-11
Delete Claim 11

Col. 10, Ln 29-36
Delete Claim 16

Col. 10, Ln 37-49
Delete Claim 17

Signed and Sealed this

Thirtieth Day of September, 2008

JON W. DUDAS
*Director of the United States Patent and Trademark Office*